US005626244A

United States Patent [19]

Mesna et al.

[11] Patent Number: 5,626,244

[45] Date of Patent: May 6, 1997

[54] BAT RACK FOR CHAIN LINK FENCE

[76] Inventors: Larry D. Mesna, 32118 Hunsacker Way; Gregory C. Mesna; Wendy L. Mesna, both of P.O. Box 2344, all of Running Springs, Calif. 92382

[21] Appl. No.: 411,266

[22] Filed: Mar. 27, 1995

Related U.S. Application Data

[63] Continuation-in-part of Ser. No. 114,786, Aug. 30, 1993, abandoned.

[51] Int. Cl.[6] ..... A47F 1/04; A47F 7/00

[52] U.S. Cl. ..... 211/60.1; 211/85.7; 248/301

[58] Field of Search ..... 211/60.1, 113, 211/66, 70.1, 70.6, 39, 68; 248/214, 303, 301

[56] References Cited

U.S. PATENT DOCUMENTS

| | | | |
|---|---|---|---|
| 1,873,297 | 8/1932 | Davenport | 248/220.31 X |
| 1,899,509 | 2/1933 | Lapin . | |
| 2,589,126 | 3/1952 | Payne | 24/343 |
| 2,622,833 | 12/1952 | Robinson | 248/211 |
| 3,266,764 | 8/1966 | Briles | 248/340 X |
| 3,653,624 | 4/1972 | Abel | 248/214 X |
| 3,698,563 | 10/1972 | Gordon et al. | 211/70.1 |
| 4,049,126 | 9/1977 | Halverson | 211/60.1 X |
| 4,583,647 | 4/1986 | Schinzing | 211/60.1 |
| 4,953,817 | 9/1990 | Mosteller | 248/303 X |
| 5,294,005 | 3/1994 | Hedges | 211/60.1 X |
| 5,364,050 | 11/1994 | Smith | 248/231.71 X |
| 5,509,632 | 4/1996 | Mesna et al. | 248/339 X |

FOREIGN PATENT DOCUMENTS

| | | | |
|---|---|---|---|
| 1096102 | 6/1955 | France | 24/370 |

*Primary Examiner*—Korie Chan
*Assistant Examiner*—Sandra Snapp
*Attorney, Agent, or Firm*—Ashen Golant & Lippman

[57] ABSTRACT

A bat rack having a generally L-shaped elongated member with a series of recesses adapted to receive the handles of baseball bats. The bat rack includes two spaced apart hooks, one of which is fixed to the member while the other is laterally moveable to adjust the spacing between the two hooks and thereby facilitate the rack's engagement with the wire of an ordinary chain link fence. The hooks are constructed to have a U-shaped cross-section in which the base of the U is folded at about a 45 degree angle to better align it with the wire of the chain link fence.

4 Claims, 2 Drawing Sheets

BAT RACK FOR CHAIN LINK FENCE

CROSS-REFERENCE TO RELATED APPLICATION

The subject application is a continuation-in-part of Ser. No. 08/114,786, filed on Aug. 30, 1993, now abandoned.

The present invention relates generally to a portable bat rack, and more particularly to a portable baseball bat rack for use in conjunction with a chain link fence.

BACKGROUND ART

The clutter of baseball bats around the playing field has been of concern for many years. Having the bats lying around is dangerous to the players who may trip and injure themselves. The bats may also be damaged if they are stepped on. Moreover, time is sometimes wasted when a prospective batter must search the dirt for his or her favorite bat. This problem was addressed in U.S. Pat. No. 4,049,126 to Halverson, where a bat rack is disclosed attached to a chain link fence by the use of wire hangers. The bat rack is also foldable in the middle to facilitate storage and transportation. A more recent attempt to develop a workable bat rack is shown in U.S. Pat. No. 5,294,005 to Hedges. There, a tubular member is used as the main support to which is attached bat hooks and other hooks. The tubular member is connected to the chain link fence by clevis pins.

Both of these racks are inadequate and neither of these bat racks have filled the need for a simple, rugged, easy to use bat rack which is relatively inexpensive and reliable.

DISCLOSURE OF THE INVENTION

A superior bat rack has finally been invented. Disclosed here is a bat rack for use with a chain link fence. The bat rack comprises at least two spaced apart hooks, each hook including a first element, and a second element integral with the first element and disposed with the first element in an L-shape before the first and second elements are folded relative to one another; the first and second elements are bent through an angle of approximately 180 degrees wherein the first and second elements are disposed generally parallel to each other and spaced one from the other; the first and second elements form a fold line which is approximately 45 degrees relative to a horizontal or a vertical reference; and an elongated member having an L-shape with two walls and a longitudinal axis, the first wall having a series of recesses adapted to receive a plurality of baseball bats and the second wall being connected to the second element of each hook wherein the connection with at least one of the hooks allows the hook to move parallel to the longitudinal axis of the elongated member.

BEST MODE FOR CARRYING OUT THE INVENTION

Figure 1:
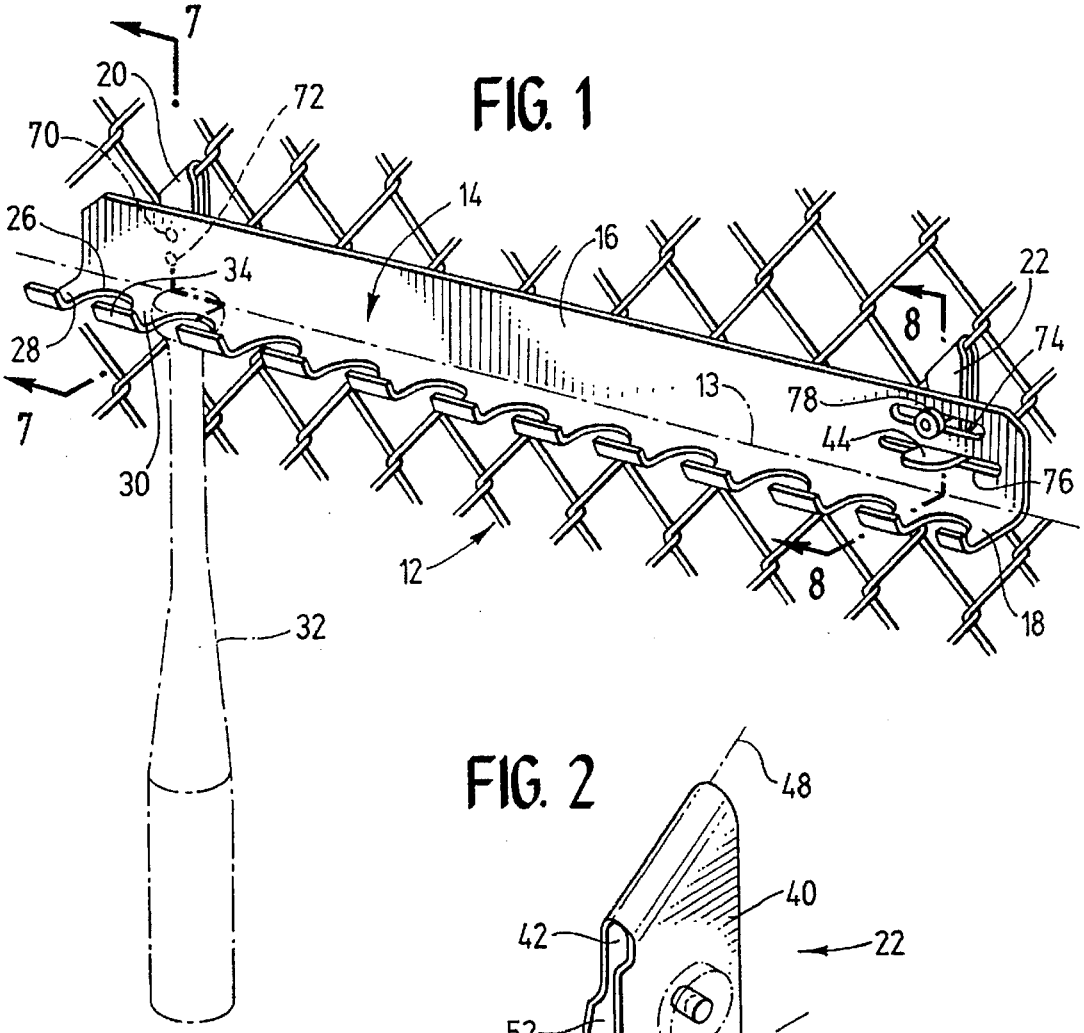
FIG. 1 is perspective view of a bat rack having two hooks and showing its use in conjunction with a portion of a chain link fence.
Figure 2:
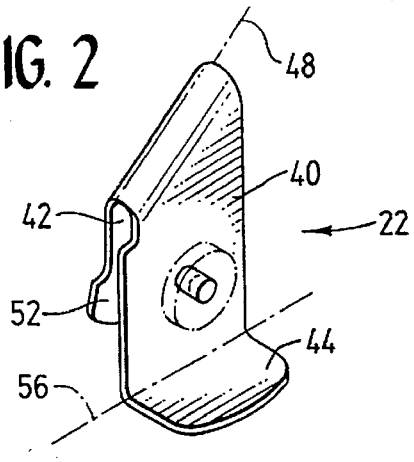
FIG. 2 is an enlarged perspective view of one of the hooks attached to the bat rack shown in FIG. 1.
Figure 3:
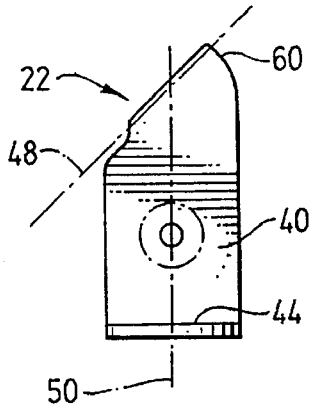
FIG. 3 is a front elevational view of the hook shown in FIG. 2.
Figure 4:
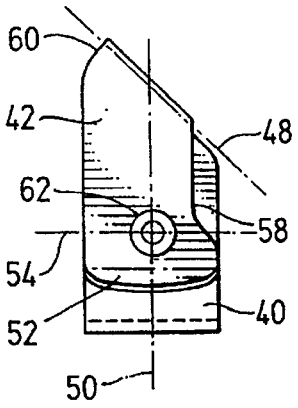
FIG. 4 is a rear elevation view of the hook shown in FIG. 2.

While the present invention is open to various modifications and alternative constructions, the preferred embodiment shown in the drawings will be described here in detail. It is to be understood, however, that there is no intention to limit the invention to the particular form disclosed. On the contrary, the intention is to cover all modifications, equivalences and alternative constructions falling within the spirt and scope of the invention as expressed in the appended claims.

Referring now to the drawings, FIG. 1 depicts a bat rack 10 of the invention engaging a typical chain link fence 12, such as those found in parks and school yards. The bat rack includes an elongated member 14, L-shaped in cross section, with a longitudinal axis 13. The rack has two walls 16 and 18. The first wall 16 is vertically disposed and is connected to two hooks, 20 and 22. The other wall 18 of the rack is disposed horizontally and includes a series of recesses such as the recess 26 located between two fingers such as the fingers 28 and 30. The recesses and the fingers are configured to receive the handle of a bat such as the bat 32 which is shown in phantom line. Each finger terminates in an upwardly directed tab such as the tab 34 to abut the handle of the bat and prevent it from inadvertently sliding off the bat rack.

To appreciate the simplicity and inexpensiveness of the rack, attention is first directed to the hooks 20 and 22 shown in FIGS. 2–6. Each of the hooks include a first element such as a depending shank 40, FIG. 2 of the hook 22 and a first element 40*a* of the hook 20. Each hook also includes a second element 42 of the hook 22, and element 42*a* of the hook 20. The hook 22 also includes a lower end portion or third element 44. The second elements 42, 42*a* are bent over to be substantially parallel to the first elements 40, 40*a* along a fold line labelled 48, 48*a* to form a U-shaped pocket for receiving the wire of the fence. The fold line of each base of the "U" is at 45 degrees to the vertical axis 50 of the first element. Each hook includes a small flap 52, 52*a* which is bent outward from a respective second element to assist in the engagement of the hook with the wire of the chain link fence. The small flaps 52, 52*a* are slightly bent along lines 54, 54*a*. This small flap is an advantageous feature of the invention in helping to "funnel" the wire of the chain link fence between the first and second elements of each hook so as to facilitate hanging the hook on the fence.

The third element 44 of the hook 22 is integral with the first and second elements and is formed after a bend along a line 56 at generally a 90 degree angle to the first element 40. The function of this third element in relation to the bat rack 10 will be explained in more detail below.

It is to be noted that both hooks 20 and 22 have second elements 42, 42*a* with reduced widths. Also, both hooks include recesses 58, 58*a*, FIGS. 5 and 6 at the inner junctions of their first and second elements. There is also a slanted surface 60 and 60*a* at the outside junction of the first and second elements of each hook.

The width of the first element on each hook is about 1 inch (2.54 cm), while the width of the second element on each hook is approximately 13/16 of an inch (2.05 cm). A hole 62, 62*a* in each of the hooks is also formed and these are about 3/8 of an inch in diameter (0.93 cm). In addition, the hook 22 has a second hole which is approximately 7/32 of an inch in diameter (0.53 cm). The width at the small flap 52, 52*a* of each hook is approximately one inch (2.54 cm). The thickness of each hook is approximately 1/16 of an inch (0.15 cm).

The distance between the first and second elements of each hook is approximately 3/16 of an inch (0.45 cm). The hooks may be coated with a distinctive color, such as by well known powder coating processes, for association with particular professional athletic teams, for example.

The hooks are manufactured from a flat piece of heavy gauge metal, such as cold roll steel. However, the particular material and its thickness are not critical to the practice of the invention so long as the hook is rigid enough for its intended purpose. Accordingly, other suitable metals or plastics of suitable strength may be used.

Figure 8:
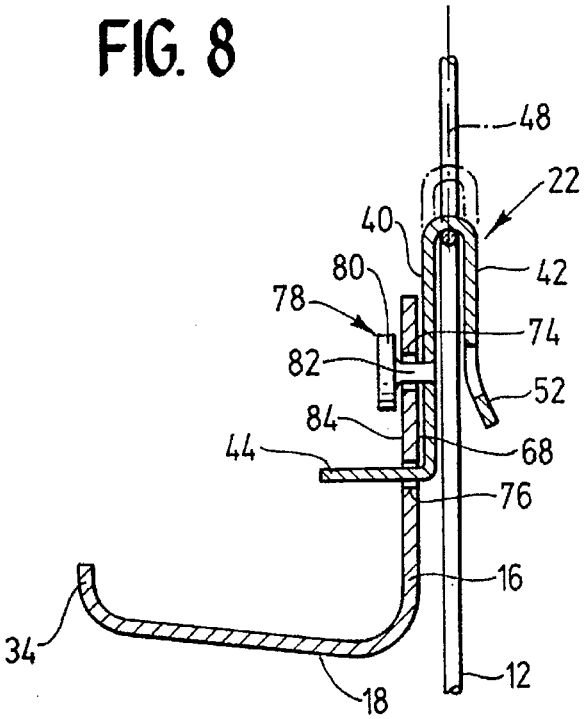
FIG. 8 is an enlarged side elevation view of the bat rack taken along line 8—8 of FIG. 1. A more complete understanding of the present invention and its advantages, features and objects will be gained from a consideration of the following description of the preferred embodiment read in conjunction with the accompanying drawings provided herein.
Figure 7:
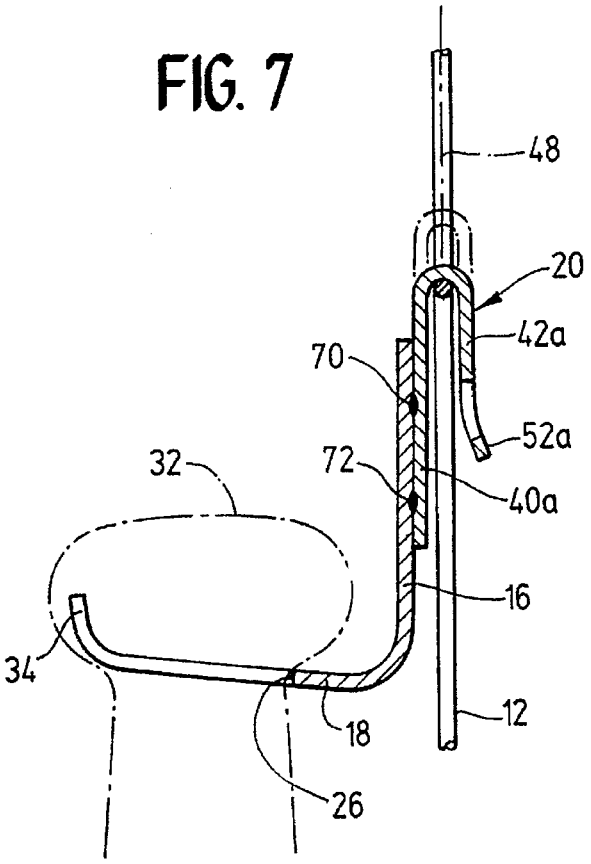
FIG. 7 is an enlarged side elevation view of the bat rack taken along line 7—7 of FIG. 1.

The relative simplicity and elegance of the bat rack is shown by reference to FIGS. 7 and 8. The hook 20 is attached to the rear surface 68 of the wall 16 of the elongated member by two spot welds 70 and 72 so that the hook is fixed in position.

Referring to FIGS. 1 and 8, there is shown two slots 74 and 76 formed in the wall 16 of the elongated member. The lower slot 76 of the two accomodates the third element 44 of the hook 22 because the hook is aligned to have its first element 40 immediately adjacent the back surface 68 of the wall 16. The upper slot 74 accomodates a fastener 78 having a head 80 and a shaft 82. The fastener is affixed to the first element 40 of the hook 22 allowing the shaft to slide within the slot 74. The head is fastened to the shaft and slides along a front surface 84 of the wall 16. With this arrangement the spacing between the two hooks is adjustable within the confines of the lengths of the slots. This allows the bat rack to accomodate any variations in the spacing of the wires of the chain .link fence to which it is mounted.

It is now appreciated that because of the nature of the fastener used to connect the hook 22 with the elongated member 14 if the third element 44 of the hook and the slot 76 were not present, the hook would rotate and be somewhat inconvenient to use. However, by having the third element of the hook received by the slot, the hook is constrained to stay in a generally vertical disposition and thus not be rotatable. The third element 44 also provides a convenient handle for the fingers of an operator to adjust its lateral position and thereby facilitate the hook's engagement with the wire of a chain link fence.

The elongated member may also be made of cold roll steel. The thickness of the member may be about 1/8 of an inch (0.30 cm) and may also be coated with a distinctive color using a powder coating process. The hooks and member may also be nickel plated.

Figure 5:
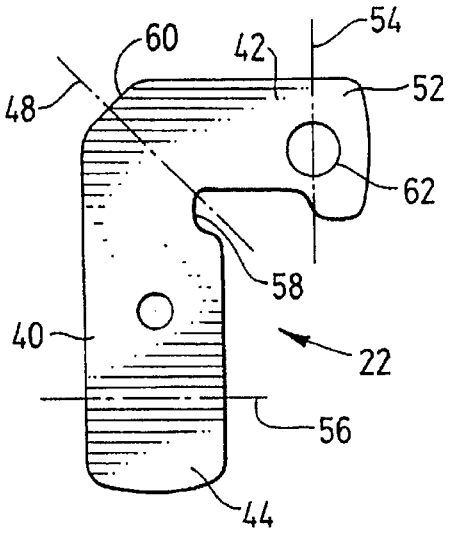
FIG. 5 is a plan view of the hook shown in FIG. 2 before it is bent into the shape shown in FIG. 2.
Figure 6:
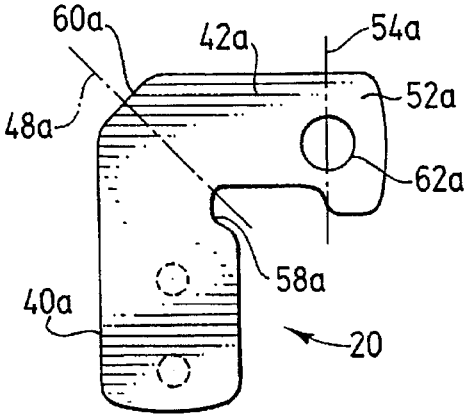
FIG. 6 is a plan view of the other hook before it is bent into the shape shown in FIG. 7.

The hooks may be manufactured by stamping each from a flat bar or sheet to form the L-shaped geometry as shown in FIGS. 5 and 6. The elongated member also may be stamped from a flat sheet to form its generally rectangular shape with the recesses and slots. Thereafter, the hooks are bent along the identified fold lines to form the shapes shown in FIGS. 2–4, 7 and 8. In a similar manner, the elongated member may be bent along its longitudinal axis to form the two walls and then bent again to form the tabs at the end of the fingers.

In use, the bat rack would be mounted to a chain link fence by first engaging the fixed hook 20 with the appropriate wire and then adjusting the moveable hook 22 laterally along the slots until it too engages a wire of the chain link fence.

What is claimed is:

1. A bat rack comprising:

at least two spaced apart hooks, each hook including a first element and a second element integral with said first element and disposed with said first element in an L-shape before said first and second elements are folded relative to one another;

said first and second elements are bent through an angle of approximately 180 degrees, wherein said first and second elements are disposed generally parallel to each other and spaced one from the other;

said first and second elements form a fold line which is approximately 45 degrees relative to a horizontal or a vertical reference;

an elongated member having an L-shape with two walls and a longitudinal axis, the first wall having a series of recesses adapted to receive a plurality of baseball bats, and a second wall being connected to the second element of each hook wherein the connection with at least one of said hooks allows said hook to move parallel to the longitudinal axis of said elongated member;

a weld connecting said elongated member and one of said hooks;

a fastener being mounted to the other of said hooks; and a slot in the second wall of said elongated member, said fastener extending through said slot whereby the spacing between said two hooks may be adjusted.

2. A bat rack as claimed in claim 1 including:

a second slot in said second wall parallel to said first mentioned slot and adapted to receive a portion of the moveable hook.

3. A bat rack as claimed in claim 2 wherein:

said portion of the moveable hook is a tab extending through said second slot adapted to act as a handle to allow the hook to be moved relative to the elongated member.

4. A bat rack as claimed in claim 3 wherein:

the extended end of the first wall with the series of recesses form fingers which are bent so as to form upwardly extending tabs adapted to engage the handle of a baseball bat in the recess to restrain the bat's movement away from the recess in which it is placed.

* * * * *